US007025242B1

(12) United States Patent
Schnell

(10) Patent No.: US 7,025,242 B1
(45) Date of Patent: Apr. 11, 2006

(54) ADJUSTABLE ANGLE MAGAZINE

(75) Inventor: John W. Schnell, Jackson, TN (US)

(73) Assignee: Black & Decker Inc., Newark, DE (US)

( * ) Notice: Subject to any disclaimer, the term of this patent is extended or adjusted under 35 U.S.C. 154(b) by 120 days.

(21) Appl. No.: 10/665,161

(22) Filed: Sep. 17, 2003

Related U.S. Application Data

(60) Provisional application No. 60/411,563, filed on Sep. 18, 2002, provisional application No. 60/471,641, filed on May 19, 2003.

(51) Int. Cl.
*B25C 3/00* (2006.01)

(52) U.S. Cl. ..... 227/120; 227/8; 227/107; 227/119; 227/148

(58) Field of Classification Search ..... 227/8, 227/32, 107, 119, 120, 127, 130, 136, 140, 227/148
See application file for complete search history.

(56) References Cited

U.S. PATENT DOCUMENTS

| | | | | | |
|---|---|---|---|---|---|
| 4,688,710 | A | * | 8/1987 | Massari et al. | 227/109 |
| 4,949,780 | A | | 8/1990 | Chen | 165/7 |
| D323,835 | S | | 2/1992 | Leu | D15/133 |
| 5,241,888 | A | | 9/1993 | Chen | 83/471.3 |
| D351,605 | S | | 10/1994 | Chen | D15/138 |
| D368,701 | S | | 4/1996 | Foy | D14/100 |
| 5,579,975 | A | * | 12/1996 | Moorman | 227/8 |
| 5,653,371 | A | * | 8/1997 | Hou | 227/109 |
| D386,192 | S | | 11/1997 | Chen | D15/132 |
| 5,694,714 | A | | 12/1997 | Basso et al. | 43/26.2 |
| D389,494 | S | | 1/1998 | Chen | D15/133 |
| D391,585 | S | | 3/1998 | Chen | D15/133 |
| D393,648 | S | | 4/1998 | Chen | D15/132 |
| 5,778,747 | A | | 7/1998 | Chen | 83/471.3 |
| 5,778,752 | A | | 7/1998 | Chen | 83/783 |
| D397,343 | S | | 8/1998 | Chen | D15/133 |
| 5,836,501 | A | | 11/1998 | Lai | 227/8 |
| 5,881,941 | A | | 3/1999 | Lai | 227/130 |
| 5,924,621 | A | | 7/1999 | Hung | 227/130 |
| 5,934,539 | A | | 8/1999 | Lee | 227/109 |
| 6,012,622 | A | * | 1/2000 | Weinger et al. | 227/8 |
| 6,024,268 | A | | 2/2000 | Horng-Lin | 227/120 |
| 6,024,269 | A | | 2/2000 | Ho et al. | 227/130 |
| 6,059,166 | A | | 5/2000 | Ho et al. | 227/130 |
| 6,059,167 | A | | 5/2000 | Ho et al. | 227/130 |
| 6,089,436 | A | | 7/2000 | Ho et al. | 227/130 |
| 6,149,046 | A | | 11/2000 | Ho et al. | 227/8 |
| 6,170,729 | B1 | | 1/2001 | Lin | 227/8 |
| 6,170,730 | B1 | | 1/2001 | Lin | 227/119 |
| 6,173,963 | B1 | | 1/2001 | Ho et al. | 277/361 |
| D442,190 | S | | 5/2001 | Chen | D15/133 |
| 6,264,085 | B1 | | 7/2001 | Ho et al. | 227/8 |
| 6,290,115 | B1 | | 9/2001 | Chen | 227/120 |
| 6,296,168 | B1 | | 10/2001 | Hung | 227/130 |

(Continued)

*Primary Examiner*—Stephen F. Gerrity
*Assistant Examiner*—Thanh Truong
(74) *Attorney, Agent, or Firm*—Suiter West Swantz pc llo

(57) ABSTRACT

An adjustable angle magazine provides the operator of a nail gun the ability to adjust the position of a housing of the magazine, which stores nails to be driven, relative to a nose casting of the nail gun. This repositioning enables an operator to employ a variety of nails, collated at a variety of angles, within the nail gun.

8 Claims, 12 Drawing Sheets

U.S. PATENT DOCUMENTS

D453,345 S 2/2002 Chen ..... D15/133
6,392,381 B1 5/2002 Chen ..... 320/111
6,394,332 B1 * 5/2002 Akiba ..... 227/8
6,397,954 B1 6/2002 Liu ..... 173/93.5
6,431,428 B1 8/2002 Chen ..... 227/120
6,651,862 B1 * 11/2003 Driscoll et al. ..... 227/123
6,880,739 B1 * 4/2005 Zhu ..... 227/109
6,892,921 B1 * 5/2005 Beville ..... 227/109

* cited by examiner

ADJUSTABLE ANGLE MAGAZINE

CROSS REFERENCE TO RELATED APPLICATION

The present application claims priority under 35 U.S.C. §119(e) to the U.S. Provisional Application Ser. No. 60/411,563, filed on Sep. 18, 2002, and the U.S. Provisional Application Ser. No. 60/471,641, filed on May 19, 2003. The U.S. Provisional Application 60/411,563 and 60/471,641 are herein incorporated by reference in their entireties.

FIELD OF THE INVENTION

The present invention generally relates to the field of pneumatic tools, and particularly to an adjustable angle magazine for use with pneumatic tools, such as a pneumatic nail gun.

BACKGROUND OF THE INVENTION

The use of pneumatic tools has greatly increased efficiency and productivity in various workplaces but particularly in the field of construction. However, pneumatic nail guns are often limited in the type of nail they may operate with. Generally, the magazines employed with the nail guns are constructed so that the nails loaded and stored present at a desired angle, such as twenty-two degrees, twenty-eight degrees, and thirty-four degrees. Thus, when working with pneumatic nail guns, it is often crucial to load the correct collated nail strip. However, it may be the case that the wrong collated nail strip is loaded into the pneumatic nail gun which may result in damage to the tool, decreased production, and increased costs.

Many pneumatic nail guns rely on the operator to determine that the correct collated nail strip has been loaded and are configured to operate correctly only with a particular type of collated nail strip. For instance, one pneumatic nail gun may require the use of clipped-head nails which are collated at one angle while another may require the use of round-head nails which may be collated at another angle. The operator of the particular nail gun is required to know the correct relationship and provide the correct nails. However, it may be the case that the operator wishes to employ both types of nails or nails collated at various angles on a particular job and is unable to do so with a typical nail gun.

Therefore, it would be desirable to provide a way of effectively enabling a variety of nail types, collated at a variety of angles to be used with a pneumatic nail gun.

SUMMARY OF THE INVENTION

Accordingly, the present invention is directed to a nail loading assembly, such as an adjustable angle magazine, that enables a pneumatic nail gun to utilize a variety of nail types. In a first aspect of the present invention, a nail loading assembly for coupling with a nail driving assembly of a nail gun is provided. The nail loading assembly comprises a housing, which may be coupled with a cover, the housing stores and provides nails to the nail driving assembly. Coupled with the housing is a universal adapter assembly which enables the pivoting coupling of the housing with the nail driving assembly. The universal adapter assembly provides the ability for a range of adjustments by the housing relative to the nail driving assembly allowing the nail gun to be variously configured as contemplated by one of ordinary skill in the art.

In a second aspect of the present invention, an adjustable angle magazine is provided which adjustably couples to a nail driving assembly of a nail gun. The adjustable angle magazine comprises a housing including a first end and a second end, the housing stores a nail and provides the nail to the nail driving assembly. An adjustment assembly is disposed proximal to the second end of the housing, the adjustment assembly for affixing the position of the housing relative to the nail gun. A universal adapter assembly is coupled to a first end of the adjustable angle magazine and enables the pivoting coupling of the adjustable angle magazine with the nail driving assembly. The fastening assembly and universal adapter assembly enable the adjustable angle magazine to be positioned at various angles relative to the nail driving assembly.

In a third aspect of the present invention, an adjustable angle nail gun is provided. The adjustable angle nail gun comprises a handle with a first end and a second end coupled with a fastening assembly. A nail driving assembly including a driver blade is coupled with the first end of the handle and is for driving a nail. An adjustable angle nose casting assembly is coupled with the nail driving assembly. The adjustable angle nose casting assembly enables the operational engagement of the driver blade with the nail. An adjustable angle magazine for storing and providing the nail is pivotally coupled with the adjustable angle nose casting assembly. A universal adapter assembly is coupled with a first end of the adjustable angle magazine and enables the pivotal coupling of the adjustable angle magazine with the adjustable angle nose casting assembly. An adjustment assembly disposed proximal to the second end of the adjustable angle magazine couples with the fastening assembly. Through the pivotal coupling provided by the universal adapter assembly and the adjustment assembly, the adjustable angle magazine is enabled to be positioned at various angles relative to the adjustable angle nose casting assembly.

The objective of providing a nail gun enabled to utilize a variety of nail types and collation angles is accomplished by the present invention through the utilization of a nail loading assembly which pivotally couples with the nail gun.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference may now be made in detail to the presently preferred embodiments of the invention, examples of which are illustrated in the accompanying drawings.

Referring generally now to FIGS. 1 through 12, exemplary embodiments of the present invention are shown.

Figure 1:
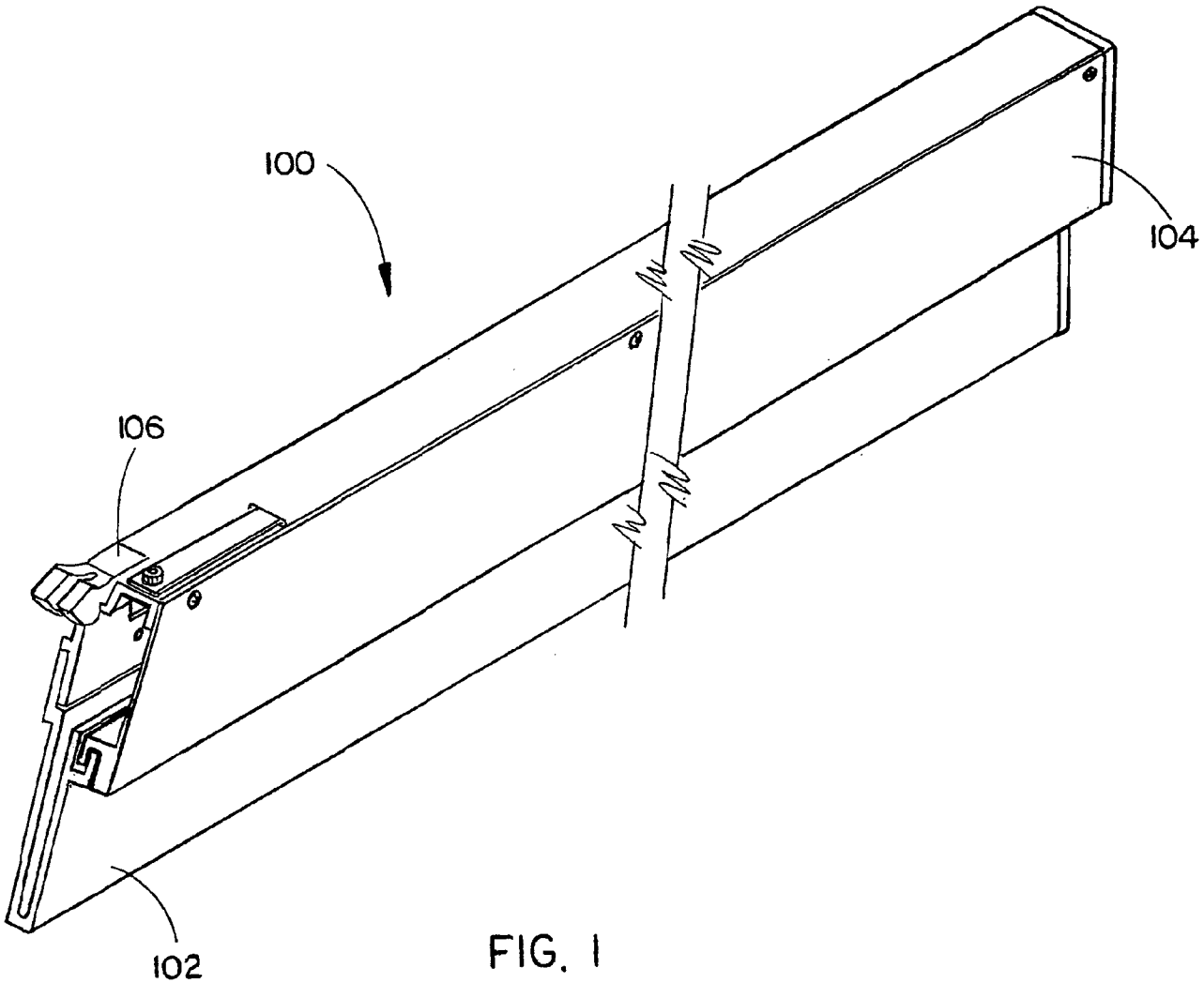
FIG. 1 is an illustration of an adjustable angle magazine including a housing, a cover, and a universal adapter assembly in accordance with an exemplary embodiment of the present invention.
Figure 2:
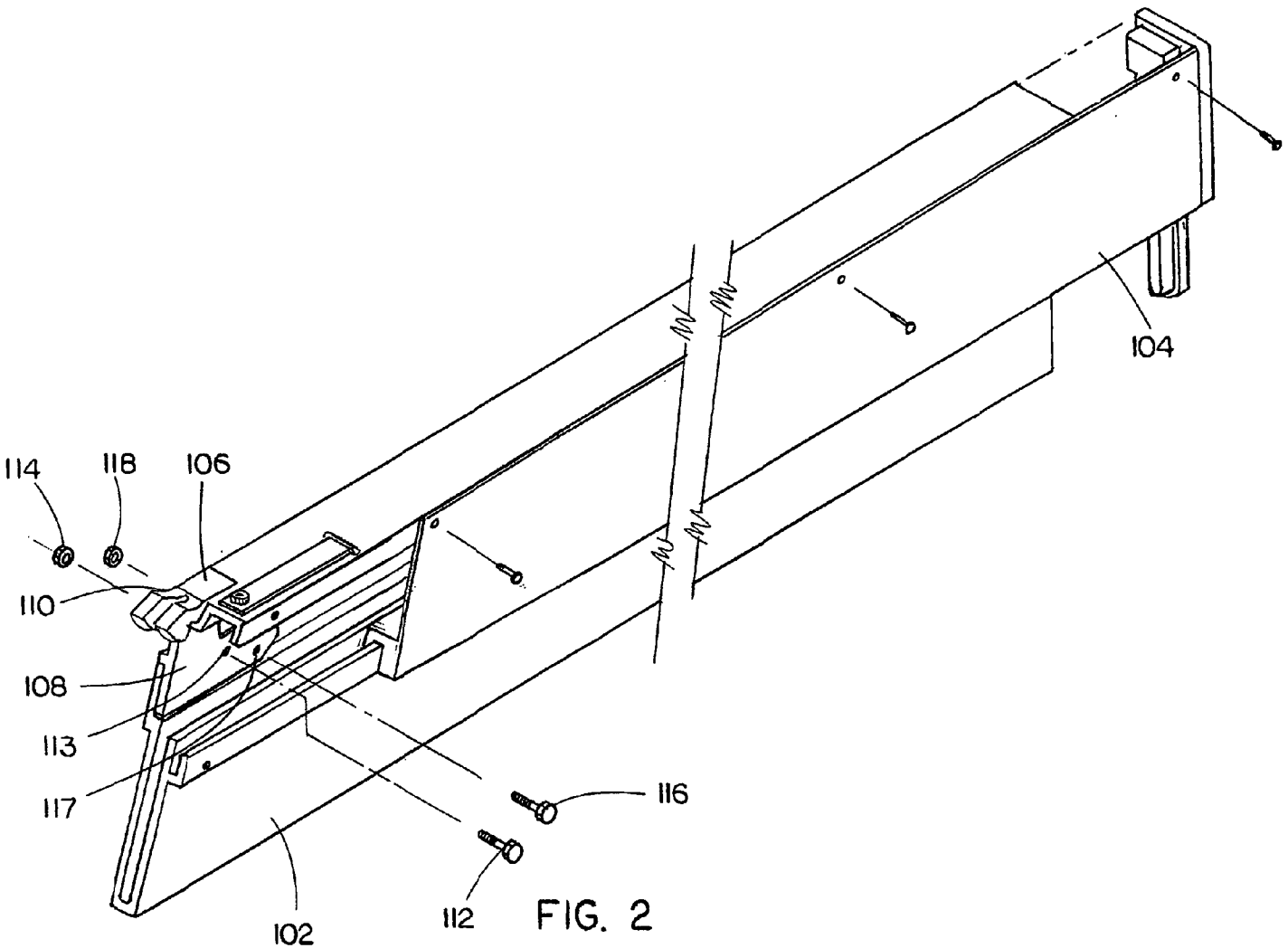
FIG. 2 is a view of the adjustable angle magazine of FIG. 1 with the cover partially removed from the housing.
Figure 3:
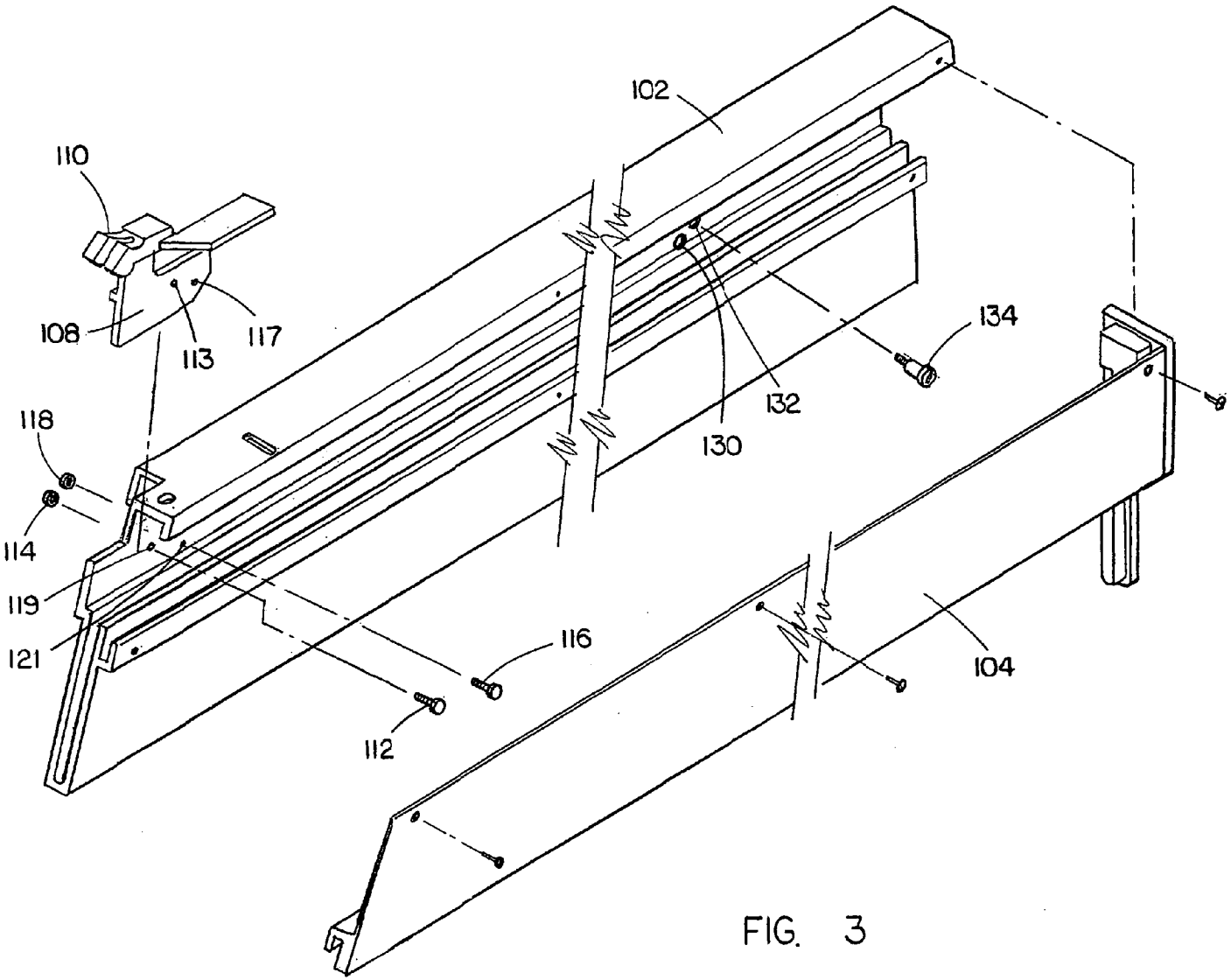
FIG. 3 is an exploded view of the adjustable angle magazine of FIG. 1.

Referring now to FIGS. 1 through 3 an adjustable angle magazine 100 is shown. The adjustable angle magazine 100 includes a housing 102 coupled with a cover 104 and a universal adapter assembly 106. The adjustable angle magazine 100, a nail loading assembly for storing nails, provides the operator of a nail gun the ability to use a variety of nail types collated at a variety of angles within the same nail gun. Preferably, the housing 102 is configured generally to appear as a standard nail gun magazine with the cover 104 slidably coupled with it.

The adjustable angle magazine 100 provides the operator of a nail gun the ability to use a variety of nail types collated at a variety of angles within the same nail gun. The housing 102 is configured generally to appear as a standard nail gun magazine with the cover 104 slidably coupled with it. The housing 102 may be configured for operation without the cover 104. In alternative embodiments, the housing 102 may be coil-type casing where the connected nails are arranged in a long belt, which winds around a spool. The coil-type casing may be configured in a variety of ways, such as a horizontal coil-type casing or a vertical coil-type casing. The cover 104 may be configured to operate with alternative embodiments, such as the coil-type casing, or may not be included. It is understood that alternative design embodiments of the housing 102 and cover 104 may be employed and do not depart from the scope and spirit of the present invention.

With the cover partially removed in FIG. 2, the universal adapter assembly 106 is shown to include a rail member 108 and a seating member 110. The rail member 108 couples with the housing 102 through the use of fasteners, such as bolts, screws, pins, and the like. The number and location through the rail member 108 and housing 102 where the fasteners are employed may vary as contemplated by one of ordinary skill in the art. In the preferred embodiment, the universal adapter assembly 106 is coupled with the housing 102 at the end of the housing 102 which engages with a nail gun. A first bolt 112 engaged by a first nut 114 and a second bolt 116 engaged by a second nut 118 secure the universal adapter assembly 106 to the housing 102. The first bolt 112 engages through a first fastening point 113 disposed on the universal adapter assembly 106. A first housing fastening point 119 aligns with the first fastening point 113 and allows the first bolt 112 to pass through and be engaged by the first nut 114. The second bolt 116 passes through a second fastening point 117 and a second housing fastening point 121 to engage with the second nut 118. It is understood that the fastening points located on both the universal adapter assembly 106 and the housing 102 may be located in various positions. Further, the method of fastening the universal adapter assembly 106 to the housing 102 may be varied. For example, the universal adapter assembly 106 may be locked in place through a compression lock assembly with a release button assembly to allow for removal from the housing 102.

As shown in the preferred embodiment of FIG. 3, the housing 102 further comprises an adjustment assembly including a first angular connection site 130 and a second angular connection site 132. These angular connection sites may be engaged by a first bolt 134 which attaches to a nail gun fastening assembly (shown in FIGS. 4 and 5) disposed on the nail gun. The position of the first and second angular connection sites 130 and 132 enables the first or second angular connection site 130 and 132 to engage with the nail gun fastening assembly coupled with the handle of a nail gun and provide a specific angle of presentation of the nail loading assembly relative to the nail gun, shown and described in FIGS. 4 and 5. The angular connection sites may be engaged by a variety of fasteners, such as screws, pins, and the like. The fasteners are extended through the first or second angular connection site 130 or 132 to engage with the nail gun fastening assembly. Upon engagement the fasteners secure the position of the nail loading assembly 100 relative to the nail gun. The fasteners may be removed from the nail gun fastening assembly, allow for the re-adjustment of the housing 102, and then re-engage the nail gun fastening assembly.

Figure 4:
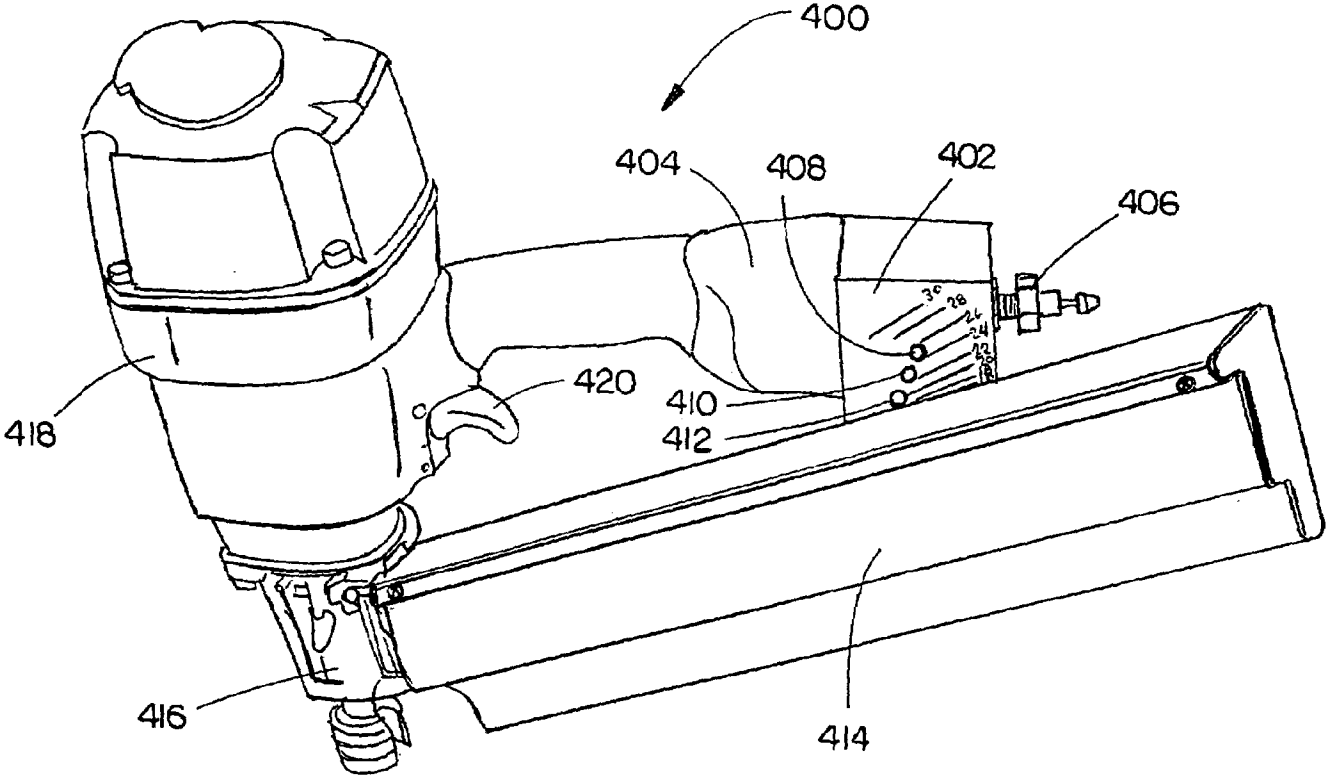
FIG. 4 is an isometric illustration of an adjustable angle nail gun including a first adjustment assembly coupled with the adjustable angle magazine.

Referring now to FIG. 4, an adjustable angle nail gun 400 including a first fastening assembly 402, is shown. The first fastening assembly 402 is coupled with a handle 404 which is coupled with a compressor connection assembly 406. The first fastening assembly 402 includes a plurality of angular adjustment sites, as exemplified by a first angular adjustment site 408, a second angular adjustment site 410, and a third angular adjustment site 412. The first fastening assembly 402 is disposed with a plurality of angle identifiers. The angle identifiers are a series of indicators associated with a printed number (i.e., 30, 29, 28, 27 . . . ) which corresponds to the angle of presentation of the adjustable angle magazine 414 to an adjustable angle nose casting assembly 416. It is contemplated that the angle identifiers may be a label with the numbers printed upon them which may be adhered to the first fastening assembly 402. Alternatively, the numbers may be engraved or painted upon the first fastening assembly 402.

The plurality of angular adjustment sites are engaged by the bolt 134, shown in FIG. 3, which connects with the plurality of angular adjustment sites through the housing of the nail loading assembly 414 of the adjustable angle nail gun 400. FIG. 3 illustrates that the housing 102 provides a first angular connection site 130 and a second angular connection site 132. The bolt 134 connects through either the first or second angular connection site 130 or 132 with the plurality of angular adjustment sites. In an exemplary embodiment, the bolt 134 connects through the second angular connection site 132 to the plurality of angular adjustment sites disposed on the fastening assembly 402. The adjustable angle nail loading assembly 414 couples with the adjustable angle nose casting assembly 416 which is coupled with a casing 418 housing a nail driving assembly coupled with a trigger 420. The casing 418 is coupled with the handle 404.

Figure 5:
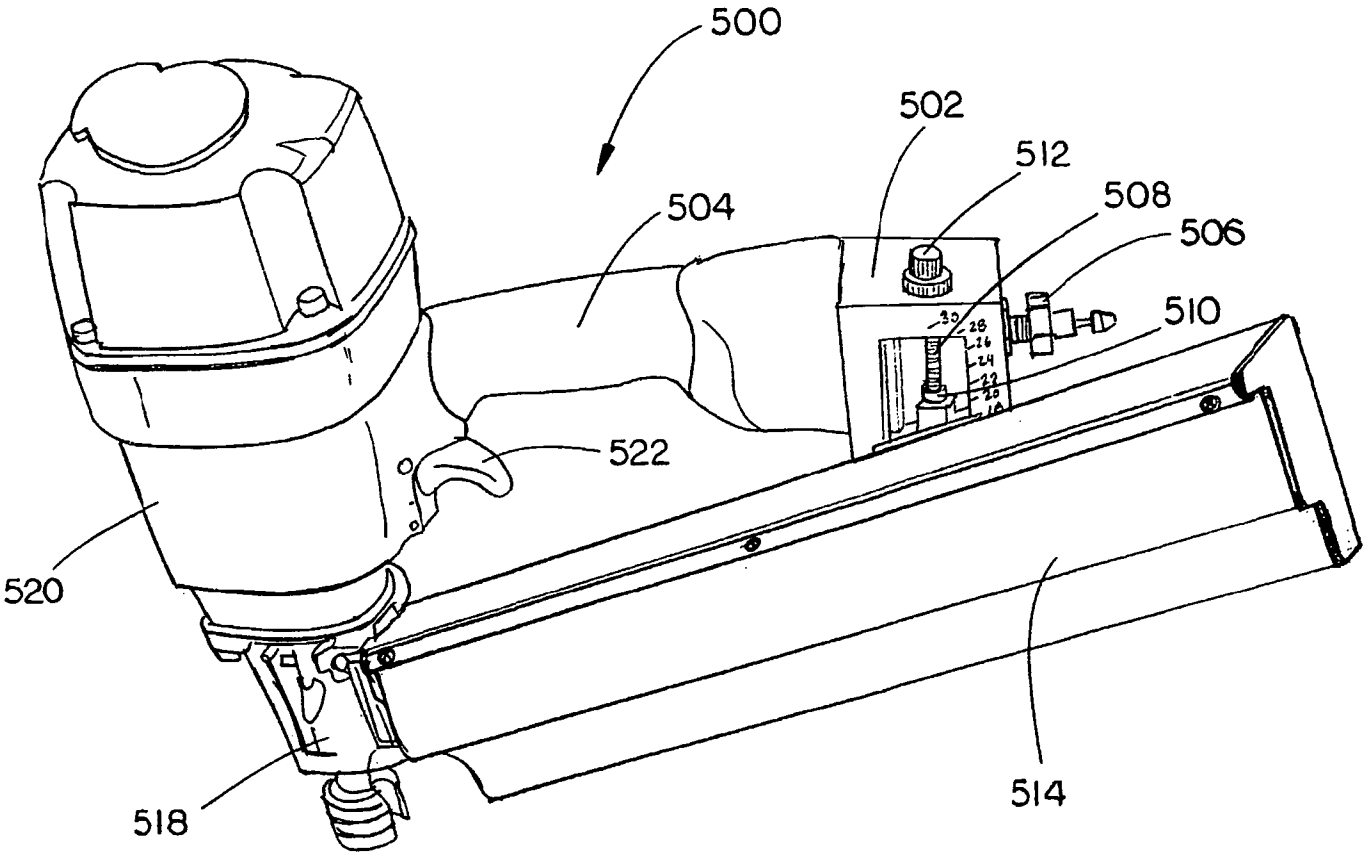
FIG. 5 is an illustration of a second adjustment assembly which may be employed with the adjustable angle nail gun for coupling the adjustable angle magazine.

In FIG. 5, an adjustable angle nail gun 500 is shown, including a second fastening assembly 502. The second fastening assembly 502 is coupled with a handle 504 coupled with a compressor connection assembly 506. Preferably, the second fastening assembly is a worm drive assembly including a spirally threaded shaft 508 operably engaging with a spirally threaded sleeve 510. The sleeve 510 at least partially encompassing the threaded shaft 508 and being spirally threaded on an internal surface. The threaded shaft 508 being coupled with a mechanical rotation assembly 512. The mechanical rotation assembly 512 may be operably engaged by the operator of the adjustable angle nail gun 500. An operator may provide rotation to the mechanical rotation assembly 512 which in turn moves the sleeve 510 up or down the threaded shaft 508 depending on the direction of the rotation imparted. Similar to the first fastening assembly 402, the second fastening assembly 502 includes angle identifiers.

The sleeve 510 is coupled with an adjustable angle nail loading assembly 514. The adjustable angle nail loading assembly 514 is coupled with an adjustable angle nose casting assembly 518 which is coupled with a casing 520 disposed with a nail driving assembly. A trigger 522 is operably coupled with the nail driving assembly, which is coupled with the handle 504.

It is contemplated that the fastening assembly employed by the present invention may be various configurations, such as a pneumatic system, hydraulic system, alternative mechanical systems, and the like. For example, the fastening assembly may utilize the compressed air provided through the compressor connection assembly by redirecting the flow of a portion of the compressed air into a guage assembly. The guage assembly may include a readout which provides a visual indication to the operator of the angle of the nail loading assembly relative to the adjustable angle nose casting of the adjustable angle nail gun. Further, the guage assembly may include an actuator which may allow the operator of the adjustable angle nail gun to alter the flow of the compressed air into the guage assembly either increasing or decreasing the flow. Alternatively, the guage assembly may provide a bleed-off valve assembly enabling the operator to regulate the release of the compressed air in the guage assembly. Either by increasing and decreasing the air flow or bleeding-off the compressed air the operator may change the angle of the nail loading assembly relative to the adjustable angle nose casting. The guage assembly may control the angle of the nail loading assembly via a piston assembly engaging with a housing of the nail loading assembly. The piston assembly may include a piston engaging a shaft. The shaft may engaged with the housing of the nail loading assembly and as the shaft moves so does the housing. The piston moves the shaft by reacting to changing air pressures within.

An alternative mechanical system may include a ratchet assembly with a hand brake. The hand brake is engaged by the operator and through pressure applied to the band brake the ratchet assembly raises or lowers the housing of the nail loading assembly. For example, the hand brake may include a spring loaded snap joint which provides incremental adjustments of the angle of the housing relative to the adjustable angle nose casting. The spring loaded snap joint engages a multi-position actuator which engages the ratcheting assembly. The hand brake may be disposed on the handle of the nail gun assembly to provide easy access and control over the nail gun assembly during operation of the hand brake.

In an alternative embodiment, the adjustable angle nail gun 500 may be a pneumatic nail gun. Further, the adjustable angle nail gun 500 may be a spring-loaded nail gun assembly. The spring-loaded nail gun assembly utilizing electricity to drive a motor which may engage a spring that drives the hammer (driver blade). In another embodiment, the adjustable angle nail gun 500 may be an electro-magnetic nail gun assembly utilizing a solenoid to provide the driving force to the driver blade. The solenoid may include an electromagnetic coil with a sliding piston inside it. Other embodiments of the solenoid may include a spring assembly to draw the piston back in. In a still further embodiment, the adjustable angle nail gun 500 may be a combustion nail gun assembly utilizing a piston driven by the firing of gas in a combustion chamber to drive the driver blade. It is contemplated that the adjustable angle nail gun may be configured as a motor driven nail gun. Thus, the adjustable angle nail gun may be configured with electric motors and the like. Further, the motors may include clutch assemblies for providing the needed force to operate the driver blade and drive a nail. The configuration of the motor and clutch assemblies employed may vary as contemplated by one of ordinary skill in the art without departing from the scope and spirit of the present invention.

Further, the adjustable angle magazine of the present invention may be disposed with various other devices and mechanisms. These may include a pick-off pivot assembly, an articulating pusher assembly, a nail checker assembly, a nail lockout assembly, a nail spacing verifier assembly, a nail shank pawl assembly, and a pinion nail verifier assembly. Additionally, the adjustable angle magazine may be enabled as a top-loading mechanism, a side-loading mechanism, and the like as may be contemplated by one of ordinary skill in the art.

Figure 6A:
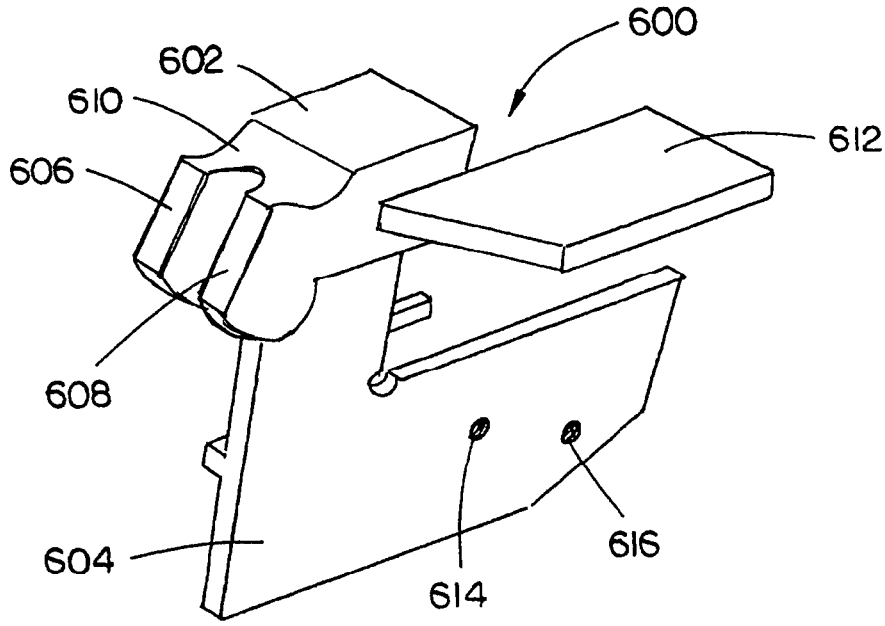
FIGS. 6A and 6B are isometric views of a universal adapter assembly in accordance with an exemplary embodiment of the present invention.
Figure 6B:
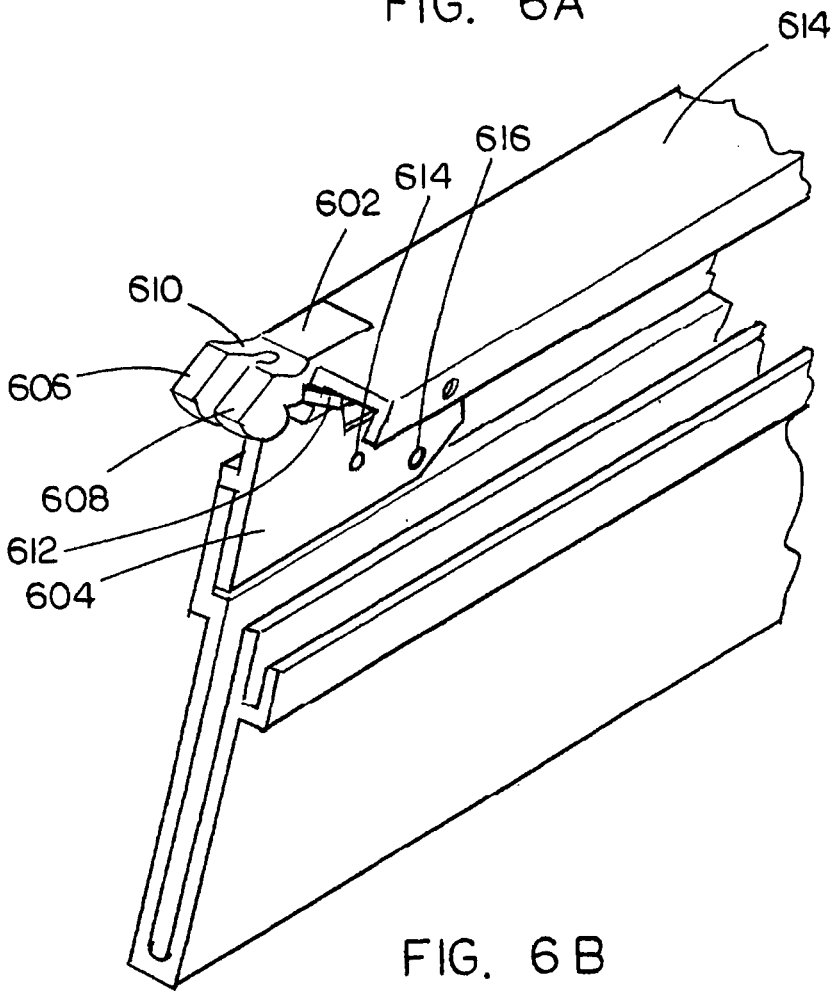

A universal adapter assembly 600 is shown in FIGS. 6A and 6B. Preferably, the universal adapter assembly 600 comprises a seating member 602 coupled with a rail member 604. Preferably, the seating member 602 is designed for engaging an adjustable angle nose casting assembly as shown and described in FIGS. 4 and 5. The adjustable angle nose casting assembly may preferably include a cradle for engagement with the seating member 602. The seating member 602 comprises a first arm 606 coupled with a second arm 608. The seating member 602 further comprises a notch 610 which is coupled with the first and second arm 606 and 608. A transition plate 612 is coupled to the second arm 608 of the seating member 602. The first and second arm 606 and 608 are configured with rounded heads for engagement with the adjustable angle nose casting assembly. This rounded head configuration enables rotational movement of the seating member 602 once engaged with the adjustable angle nose casting assembly. The notch 610 is disposed across both the first and second arm 606 and 608, and may be engaged by a cradle fastening assembly included on the adjustable angle nose casting assembly. Preferably, the notch 610 comprises a smooth surface to allow the cradle fastening assembly to slide upon it thereby enabling the rotational movement of the seating member 602.

The transition plate 612 provides a connection to the nail loading assembly 614, which is similar to the nail loading assembly 100 described previously. The transition plate 612 may engage with the nail loading assembly to securely affix the seating member. The rail member 604 provides further connection to a nail loading assembly. The rail member 604 couples along a side of the nail loading assembly 614. In the exemplary embodiments shown, the rail member 604 is disposed with a first fastening point 614 and a second fastening point 616. Preferably, the first and second fastening point 614 and 616 are apertures through the rail member 604. The apertures allow a fastener, such as a bolt, screw, clip, pin, and the like, to affix the rail member 604 to a surface, such as a nail loading assembly.

Figure 7:
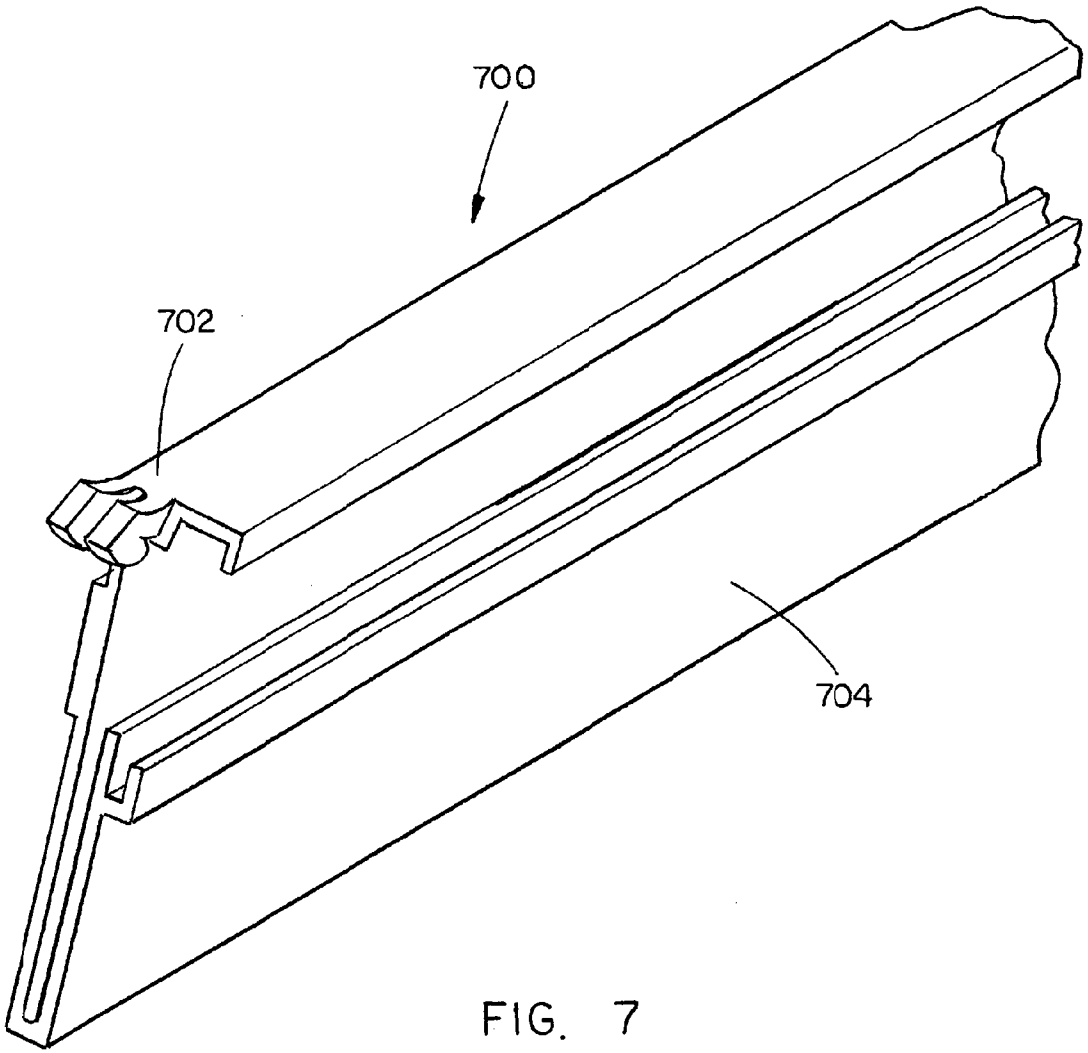
FIG. 7 is an illustration of an adjustable angle magazine including an integrated universal adapter assembly.

Referring now to FIG. 7, an adjustable angle nail loading assembly 700 including an integrated universal adapter assembly 702 is shown. The universal adapter assembly 702 is integrated at the end of a housing 704 which couples with the nail gun, preferably through an adjustable angle nose casting assembly. The integrated universal adapter assembly 702 may provide increased structural strength to the adjustable angle nail loading assembly 700, thereby increasing its productive life cycle. Further, the integrated universal adapter assembly 702 reduces the possibility of lost time and increased costs if the universal adapter assembly is removable and it gets misplaced. Such a circumstance may also decrease production due to the fact that the nail gun may be unable to engage with the nail loading assembly when the universal adapter assembly is missing.

Figure 8:
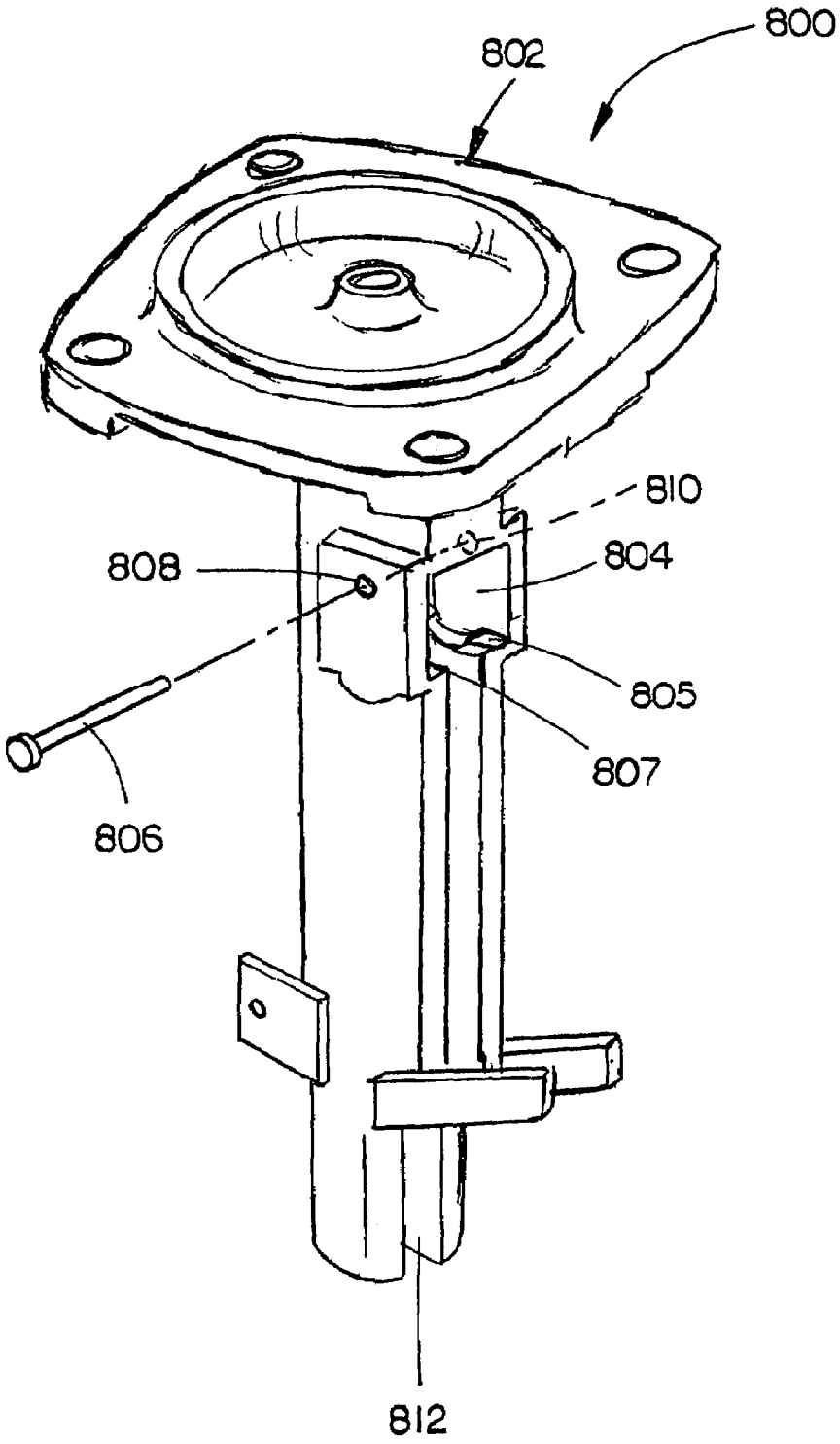
FIG. 8 is an isometric illustration of an adjustable angle nose casting assembly including a cradle and cradle fastening assembly.
Figure 9:
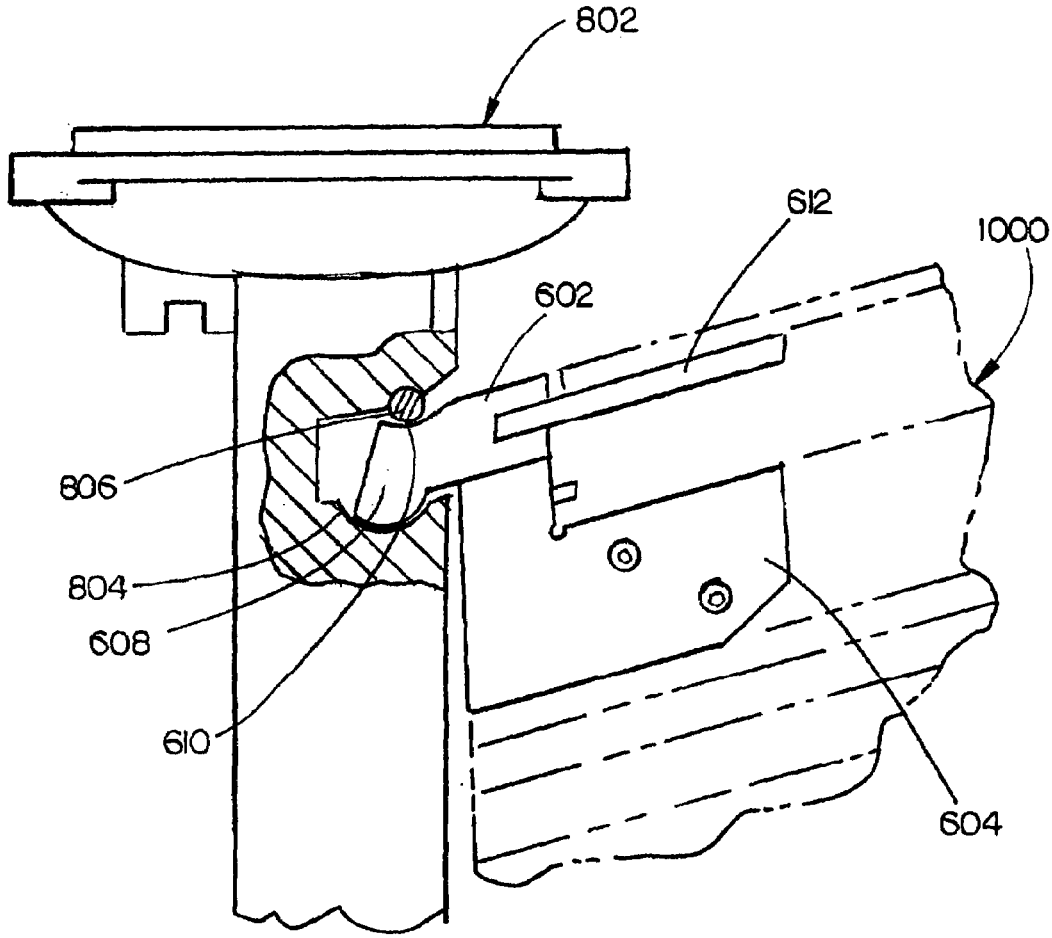
FIG. 9 is a cut-away view illustrating the coupling of the universal adapter assembly with the cradle and cradle fastening assembly.
Figure 10:
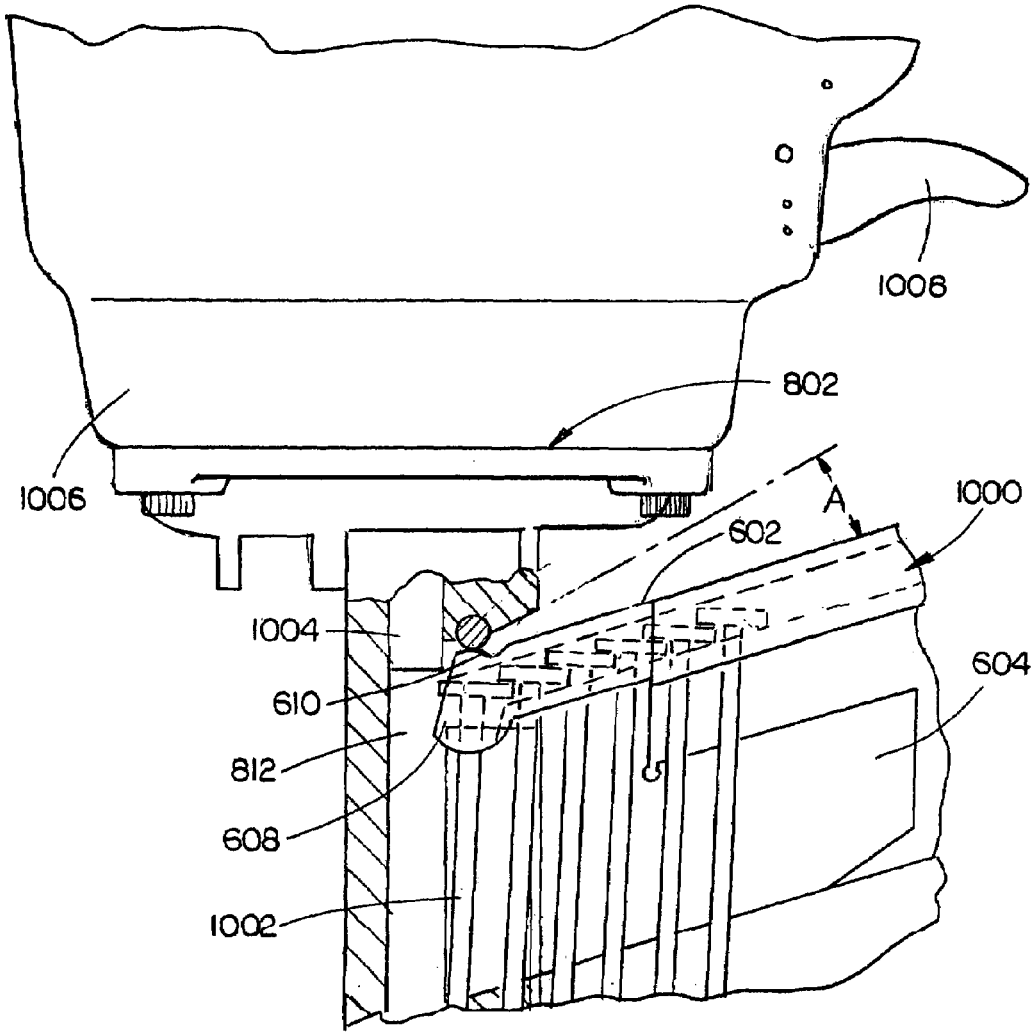
FIG. 10 is a perspective view illustrating the adjustable angle magazine loading a nail, of a collated nail strip, into the adjustable angle nose casting assembly via the coupling of the universal adapter assembly with the cradle and cradle fastening assembly and a range of angles the adjustable angle magazine may be adjusted to relative to the adjustable angle nose casting assembly.

Referring generally now to FIGS. 8 through 10, an adjustable angle nose casting assembly 800 is shown. In operation, a phlange 802 enables the coupling of the adjustable angle nose casting assembly with a nail driving assembly of a nail gun (adjustable angle nail gun). The phlange 802 preferably couples with a casing which at least partially encompasses the driver and a driver blade 1004 (shown in FIG. 10) of the nail driving assembly. The phlange 802 further defines a driver blade channel 812. The driver blade channel 812 enabling operation of the nail gun by allowing a collated nail strip 1002 from the adjustable angle nail loading assembly 1000 (shown in FIGS. 9 and 10), commonly referred to as an adjustable angle magazine, to load a nail, at least partially, into the driver blade channel 812 and then allowing the driver blade 1004 to extend through the channel 812, driving the nail out from the adjustable angle nail gun and into a surface.

The adjustable angle nose casting assembly 800 operationally couples with the seating member 602 of the universal adapter assembly 600 within a cradle 804, as shown in FIG. 9. The cradle 804 is a defined coupling assembly within the adjustable angle nose casting assembly 800, providing a first engagement ledge 805 and a second engagement ledge 807. The first and second engagement ledge 805 and 807 are disposed on the interior of the space defined by the cradle 804 within the adjustable angle nose casting assembly 800. In operation, the first arm 606 and the second arm 608 pivotally engage with the first engagement ledge 805 and the second engagement ledge 807, respectively.

The adjustable angle nose casting assembly 800 is further disposed with a cradle fastening assembly comprising a pin 806, a first pin receiver 808, and a second pin receiver 810. In the preferred embodiment, it is seen that the pin 806 is enabled to be inserted into and removed from the first and second pin receiver 808 and 810. As seen in FIGS. 9 and 10, the pin 806 is inserted through the first and second pin receivers upon engagement of the first and second arm 606 and 608 with the first and second engagement ledge 805 and 807, respectively. Once inserted through the pin receivers, the pin 806, is in operational engagement with the notch 610 disposed across the first and second arm 606 and 608. The pin 806 is configured to prevent the first and second arm 606 and 608 from disengagement with the cradle 804 during operation of the nail gun. The pin 806, during non-operational periods of the adjustable angle nail gun, may be removed from the first and second pin receivers, which allows the first and second arms to be removed from the cradle 804, thereby enabling removal of the adjustable angle nail loading assembly 1000 from the adjustable angle nose casting assembly 800. However, the configuration of the pin 806 engaged through the first and second pin receivers allows the first and second arm 6060 and 608 to pivot within the cradle 804, thereby maintaining the operational capabilities of the adjustable angle nail loading assembly 1000 including the universal adapter assembly 600 coupled with the adjustable angle nose casting assembly 800.

It is understood that while a preferred embodiment of the cradle fastening assembly has been described, other configurations may be employed without departing from the scope and spirit of the present invention. For example, the cradle fastening assembly may employ two pins for engaging through the first and second pin receivers. Alternatively, the first and second pin receivers may comprise a spring loaded assembly which engages with the pin. In such an embodiment, the pin or pins may be enabled to remain in the first and second pin receivers and still allow the first and second arms to be inserted and removed from the cradle 804.

An expanded view of the coupling of the adjustable angle nail loading assembly with the adjustable angle nose casting assembly 800, is shown in FIG. 10. The universal adapter assembly 600 is coupled with the adjustable angle nail loading assembly and the second arm 608 is shown engaged with the adjustable angle nose casting assembly 600. In operation of a nail gun, the adjustable angle nose casting assembly 600 may be coupled to a casing 1006 which houses the driver and driver blade 1004 activated by a trigger 1008, disposed on the nail gun. A seating member 602, via the first and second arm 606 and 608, of the universal adapter assembly 600 is engaged with the first and second engagement ledge 805 and 807 of the cradle 804. As previously mentioned, the seating member 602 is allowed to rotate within the cradle 804 which enables the adjustment of the angle that the adjustable angle nail loading assembly may be presented to the adjustable angle nose casting assembly 800. The angle may be limited to a specific range of angles, defined in FIG. 10 by the letter "A". This range of angle may be unlimited or may be limited, preferably to a range of zero to fifteen degrees. As a result of the rotational capabilities of the seating member 602 within the cradle 804, the adjustable angle nail loading assembly 1000 may employ a variety of collated nail strips, such as the round-head collated nail strip 1002 shown in the exemplary embodiment, for use with an adjustable angle nail gun. This enables the nail gun as a multi-functional tool which increases its productivity and value on the worksite.

Figure 11:
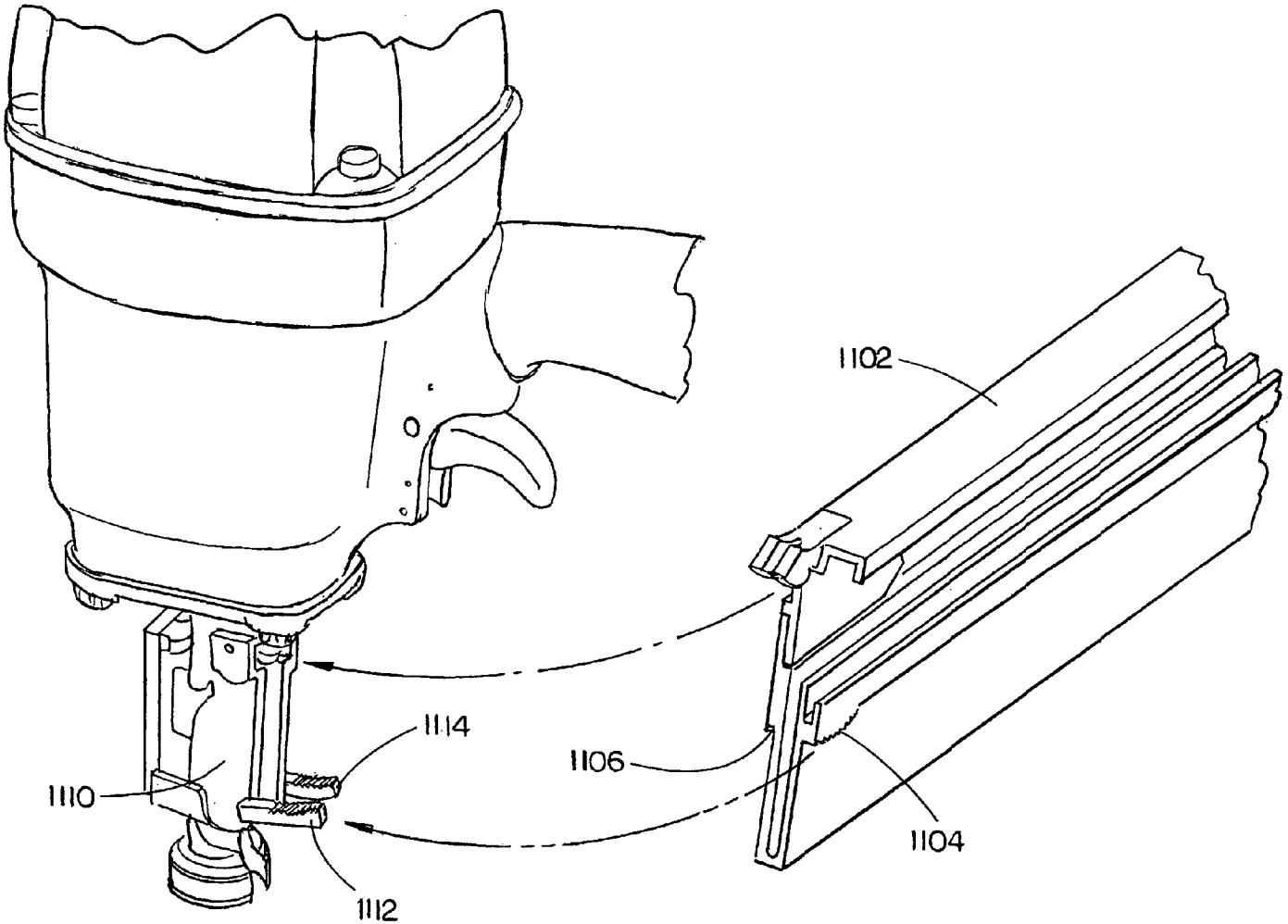
FIG. 11 is an illustration of an adjustable angle magazine including a support assembly for coupling with an adjustable angle nail gun.

A support assembly comprising a first support member 1104 and a second support member 1106 disposed on a housing 1102 of an adjustable angle nail loading assembly, is shown in FIG. 11. The adjustable angle nail loading assembly is similar in every respect to the adjustable angle nail loading assembly/adjustable angle magazine shown and described in FIGS. 1 through 10, except for the first and second support members. The first and second support member 1104 and 1106 are configured to engage with a support bar assembly coupled with the adjustable angle nose casting assembly 1110 which is similar to the adjustable angle nose casting assembly shown and described in FIGS. 1 through 10. The support bar assembly comprising a first support bar 1112 and a second support bar 1114 that protrude from the adjustable angle nose casting assembly 1110. The engagement of the support bars and members provide stability to the nail loading assembly during operation of an adjustable angle nail gun. In the preferred embodiment, the first and second support members 1104 and 1106 comprise separate sections of the housing and include serrated or toothed sections. These serrated or toothed sections of the first and second support member 1104 and 1106 are designed to engage with complimentary serrated or toothed sections disposed upon the first and second support bar 1112 and 1114. Additionally, this combination is designed to be a releasable engagement, allowing for the easy adjustment of the angle of the housing 1102 relative to the adjustable angle nose casting assembly 1110.

In the alternative the first and second support members may be coupled to the first and second support bars and include a mechanism for concomitant adjustment when the adjustment assembly is re-adjusted. For example, a worm drive assembly may be employed that allows for movement to adjust and then locks in place when the desired position has been reached. Alternatively, a compression lock assembly may be employed to accomplish the same re-positioning enabled by the adjustment assembly in combination with the nail gun fastening assembly discussed previously.

Figure 12:
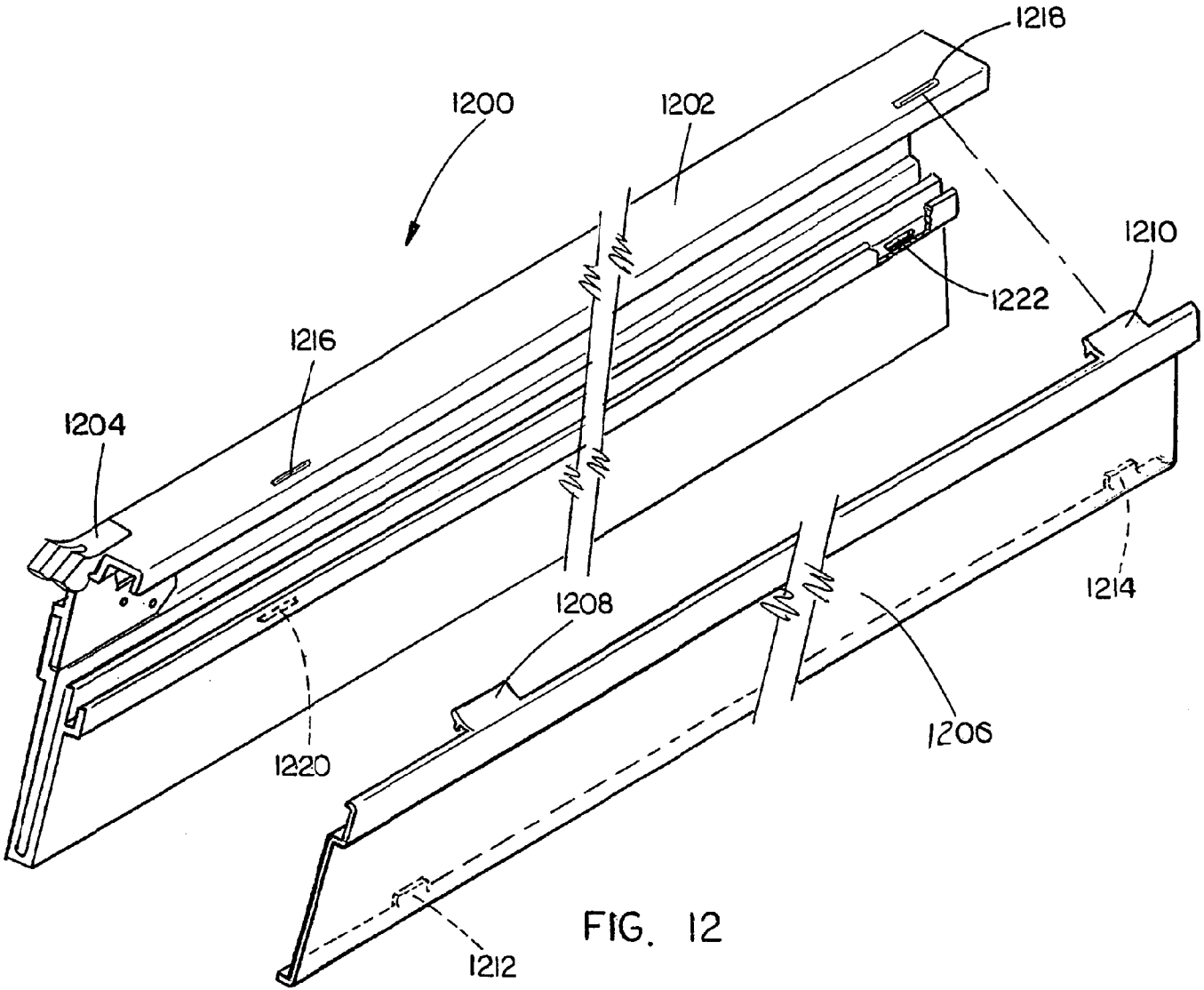
FIG. 12 is an illustration of an adjustable angle magazine comprising a housing, a universal adapter assembly, and a compression lock cover.

FIG. 12 illustrates an adjustable angle magazine 1200 comprising a housing 1202 coupled with a universal adapter assembly 1204. The adjustable angle magazine 1200 being similar to the adjustable angle magazines shown and described in FIGS. 1 through 11, except that the housing 1202 is enabled to engage with a compression cover 1206. The compression cover 1206 engages with the housing 1202 through a compression lock system comprising a plurality of compression clips, exemplified by a first compression clip 1208, a second compression clip 1210, a third compression clip 1212, and a fourth compression clip 1214, disposed on the cover 1206 and a plurality of compression connection sites, exemplified by a first compression connection site 1216, a second compression connection site 1218, a third compression connection site 1220, and a fourth compression connection site 1222, disposed on the housing 1202. Other systems and methods of coupling the cover to the housing may be employed as contemplated by one of ordinary skill in the art.

It is believed that the adjustable angle magazine of the present invention and many of its attendant advantages may be understood by the forgoing description. It is also believed that it may be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A nail loading assembly for coupling with a nail driving assembly of a nail gun, comprising:

a housing for storing nails and providing nails to the nail driving assembly;

a universal adapter assembly coupled with the housing, the universal adapter assembly for pivotally coupling the housing with the nail driving assembly, the universal adapter assembly including a seating member coupled with a rail member and a transition plate, the universal adapter assembly configured for being received by an adjustable angle nose casting assembly of the nail driving assembly;

a support assembly disposed on the housing having a support member, wherein said support member having serrated portion;

a support bar assembly disposed on the angle nose casting assembly having a support bar, wherein said support bar having serrated portion;

wherein said serrated portion of said support member configured to engage said serrated portion of said support bar;

wherein the universal adapter assembly enables the nail loading assembly to be positioned at various angles relative to the nail driving assembly.

2. The nail loading assembly of claim 1, further comprising an adjustment assembly disposed on the housing.

3. The nail loading assembly of claim 1, wherein the nail loading assembly further comprises a cover coupled with the housing, the cover being removable from the housing.

4. The nail loading assembly of claim 3, wherein the support assembly is disposed on the cover.

5. The nail loading assembly of claim 1, wherein the nail gun is selected from the group consisting of a spring-loaded nail gun, a pneumatic nail gun, an electromagnetic nail gun, a combustion nail gun, and a motor driven nail gun.

6. An adjustable angle magazine for use with a nail gun, comprising:

a housing including a first end and a second end, the housing for storing nails and providing nails to a nail driving assembly of the nail gun;

an adjustment assembly disposed proximal to the second end of the housing, the adjustment assembly for affixing the position of the housing relative to the nail gun;

a universal adapter assembly coupled with the first end of the housing, the universal adapter assembly for pivotally coupling with the nail driving assembly, the universal adapter assembly including a seating member coupled with a rail member and a transition plate, the universal adapter assembly configured for being received by an adjustable angle nose casting assembly of the nail driving assembly;

a support assembly disposed on the housing having a support member, wherein said support member having serrated portion;

a support bar assembly disposed on the angle nose casting assembly having a support bar, wherein said support bar having serrated portion;

wherein said serrated portion of said support member configured to engage said serrated portion of said support bar;

wherein the universal adapter assembly and the adjustment assembly enable the adjustable angle magazine to be positioned at various angles relative to the nail driving assembly.

7. The adjustable angle magazine of claim 6, further comprising a cover coupled with the housing, the cover capable of being removed from the housing.

8. The adjustable angle magazine of claim 6, wherein the nail gun is selected from the group consisting of a spring-loaded nail gun, a pneumatic nail gun, an electromagnetic nail gun, a combustion nail gun, and a motor driven nail gun.

* * * * *